US006811110B2

(12) United States Patent
Tsao

(10) Patent No.: US 6,811,110 B2
(45) Date of Patent: Nov. 2, 2004

(54) REELING DEVICE FOR FIRE HOSES

(76) Inventor: Cheony-Sun Tsao, 4F, No. 20, Yuu Nurng Road, Shih-Lin, Taipei (TW)

( * ) Notice: Subject to any disclaimer, the term of this patent is extended or adjusted under 35 U.S.C. 154(b) by 0 days.

(21) Appl. No.: 10/291,399

(22) Filed: Nov. 12, 2002

(65) Prior Publication Data

US 2004/0089761 A1 May 13, 2004

(51) Int. Cl.[7] ..... B65H 18/10; B65H 75/28

(52) U.S. Cl. ..... 242/530.2; 242/532.6; 242/546.1; 242/388.5; 242/395

(58) Field of Search ..... 242/530.2, 532.6, 242/546.1, 388.1, 388.5, 395, 395.1, 402, 587.2

(56) References Cited

U.S. PATENT DOCUMENTS 2,960,279 A * 11/1960 Little ..... 242/532.6
3,254,862 A * 6/1966 Bates et al. ..... 242/395
4,057,198 A * 11/1977 Whitfield ..... 242/532.6
4,198,010 A * 4/1980 Knapp ..... 242/532.6
5,566,901 A * 10/1996 Wilder ..... 242/532.6
6,332,586 B1 * 12/2001 Risa et al. ..... 242/530.2

* cited by examiner

*Primary Examiner*—John M. Jillions
(74) *Attorney, Agent, or Firm*—Bacon & Thomas, PLLC

(57) ABSTRACT

A reeling device for fire hoses. The device includes a winch, a gearing kit that controls the winch and an operating handle. The device is installed on a structural rack in which of the two protruding axles arranged on the winch, one is secured and turns along with the winch and the other is movably situated at the center of the winch and controlled by the handle for telescopic movement, thereby allowing the twin axles to hold and reel the fire hose and allowing the removal of fire hose easily from the winch by withdrawing one of the axles after reeling the fire hose. In addition, the device features the gearing kit for transmission of the hose through the change of number of gears of the gearing kit as a way to reel the hose with less effort than traditional manual reeling.

12 Claims, 7 Drawing Sheets

REELING DEVICE FOR FIRE HOSES

FIELD OF THE INVENTION

This invention relates to a reeling device for fire hoses, which provides a structure to manipulate the winch by means of gears, as a way to reel the hose with less effort than the traditional manual reeling.

BACKGROUND OF THE INVENTION

Fire fighting is a dangerous task that demands good timing as each and every step is essential and this is true when it comes to fire hose. It is a highly skillful practice knowing to deploy the fire hose next to the fire as soon as possible without leaving fire fighters vulnerable to bum. To have the fire hose always ready for use, it is essential to have it reeled properly. In a day-to-day practice, fire fighters would manually reel a flexible fire hose containing excessive water after using it each time. This suggests a hard task, as first the fire hose would be spread out on the floor before reeling it inch by inch from a specific end. Remaining water is squeezed out in the reeling process that is supposed to be completed in one operation, or a reeled hose would become loose, requiring a new reeling. Besides, a manually reeled fire hose would show an uneven side, making its storage less successful and when using it again by releasing the hose, the uneven side would keep the hose from rolling smoothly and reaching any desired spot.

SUMMARY OF THE INVENTION

In order to solve all problems of the time-consuming effort and uneven hose by manual reeling in the traditional practice, the inventor is presenting a kind of reeling device for fire hoses that includes a winch, a gearing kit that controls the winch and an operating handle for the winch and the structural rack to house all the above elements. The central axle hole on the winch comes in the form similar to a figure eight, allowing passage of the two axle centers, of which one fixed axle center passes through the eccentric position of the hole of the winch and connects one end onto the end of the axle center of the winch while the adjacent moving axle center comes in the center of the hole, having a threaded section that allows it to protrude to a specific point and driving the winch by means of the gearing kit and at the same time, holding the fire hose for reeling along with the aforementioned fixed axle center or recessing from the winch dial alone, loosening the center hole that allows easy removal of the hose after reeling. The gearing kit of the invention is made of four gears, of which the first and the second gears have identical gearing ratio while the third gear that comes coaxial with the second one has fewer teeth and engages with the fourth gear having fewer teeth and coaxial with the winch, constructing thus a reducing gearing kit. The first gear is driven directly by a handle that, with the handle arm and the reducing gear, increases the torque and has the fire hose held between the two axle centers to be reeled easily. Another characteristics of the gearing kit is that, with the handle turning clockwise, the transmission in the gearing kit provided by the first, the second, the third and the fourth gear drives the winch for reeling and when turning the handle counterclockwise, only the moving axle center is threaded out, not the winch.

Other characteristics of this invention include a pair of limit rods located on the top of both sides of the structural rack that allow the fire hose be reeled between the two limit rods, eliminating thus physical fatigue in a manual reeling.

On the other hand, this invention provides a long rod which, when not in use, is kept in the hollowed rod in the structural rack and when in use, it is kept in front of the winch at a distance that is roughly larger than the width of the flattened hose, making this a limit barrier to the reeling so that a reeled hose would have even edges. Thanks to the operation of the aforementioned device of this invention, a troublesome, time-consuming and accurate hose reeling task will turn out to be an easy, effortless and practical reeling job.

DETAILED DESCRIPTION OF PREFERRED EMBODIMENT

Figure 1:
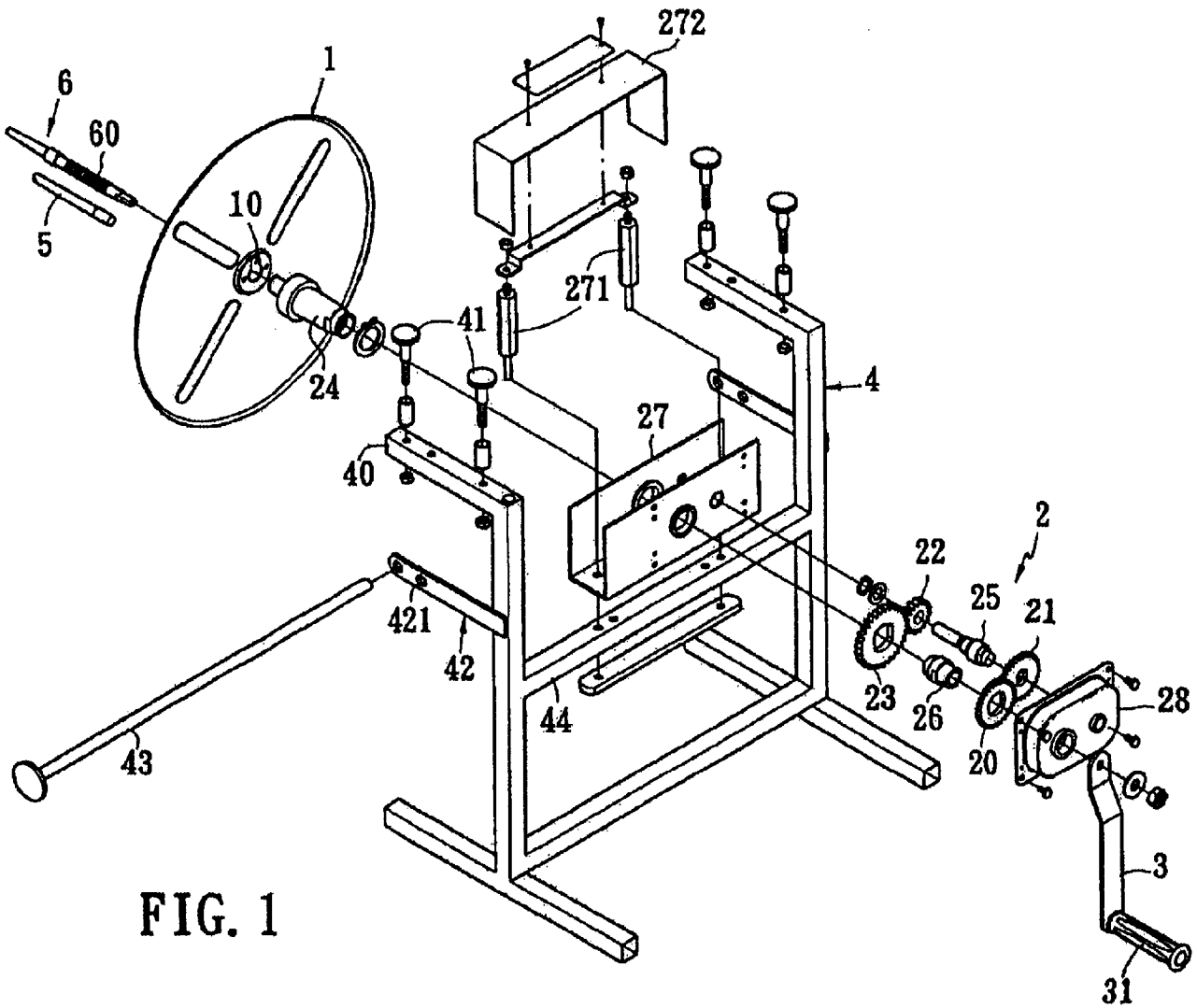
FIG. 1 is a layout of disassembled elements of this invention.
Figure 2:
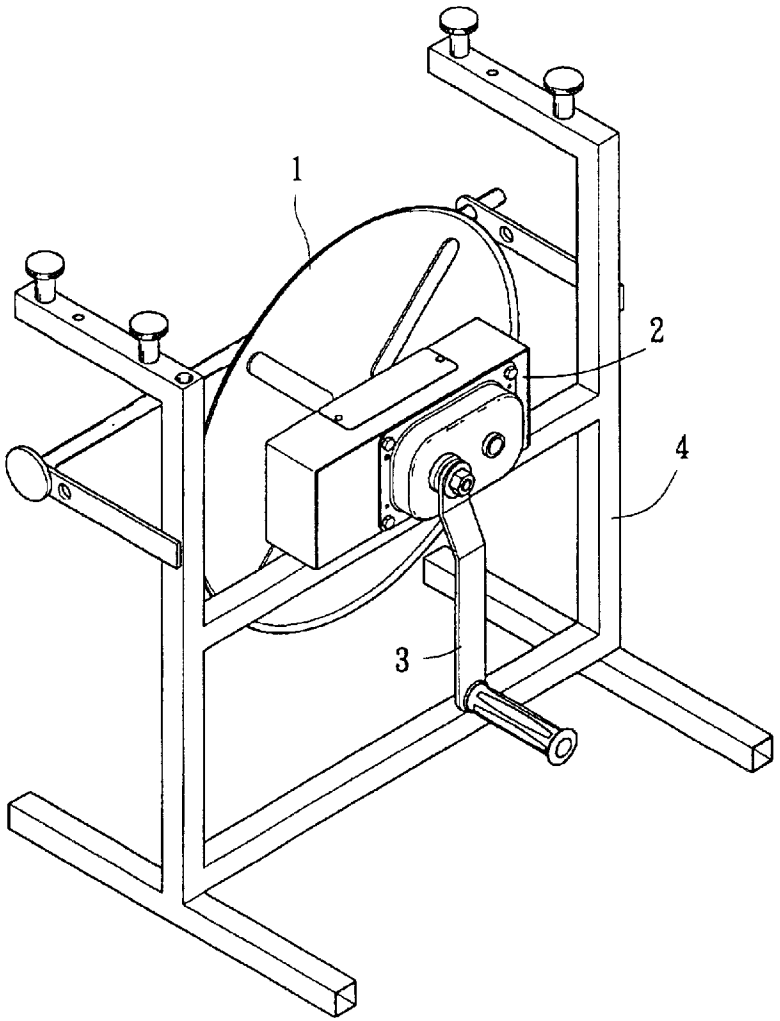
FIG. 2 is a vertical assembly layout of this invention.
Figure 3:
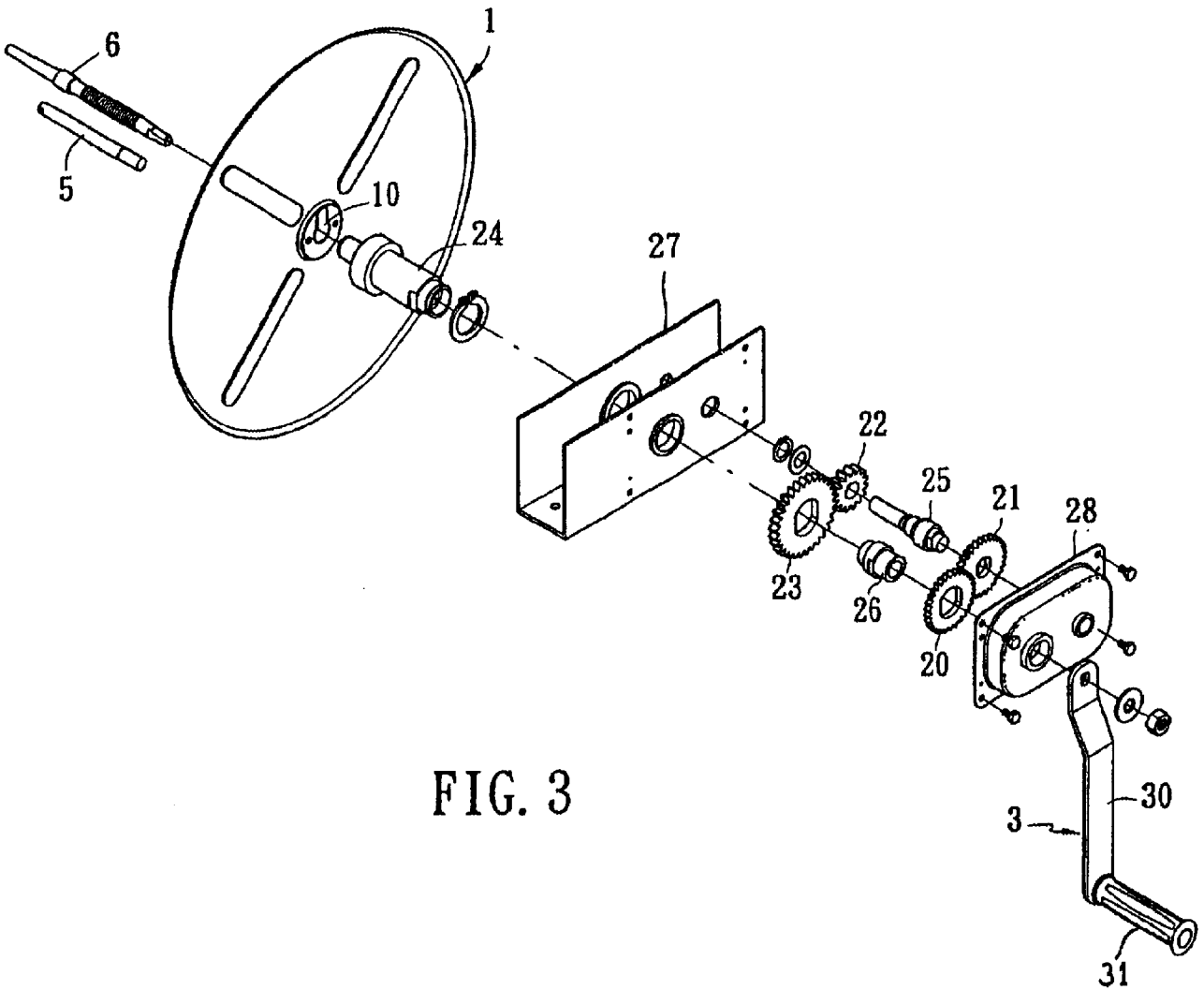
FIG. 3 is a vertical assembly layout of the components of the gearing kit and the winch of this invention.

Structures of embodiments of this invention are shown in FIG. 1~3, including a winch 1, a gearing kit 2, a handle 3 and a structural rack 4, where the center of winch 1 has an axle hole 10 in the form similar to a figure eight, allowing passage of the two axle centers, of which one fixed axle center 5 passes through the top of axle hole 10 while the other moving axle center 6 passes through the center of axle hole 10, having one section of the moving axle center 6 a thread 60. The gearing kit 2 is made of the first gear 20, the second gear 21, the third gear 22 and the fourth gear 23, plus the axle centers 24, 25, 26 that string the gears and the support 27 and support cap 28 for installation of these axle centers. Handle 3 has a long arm 30 with one end and the perpendicular grip 31; the structural rack 4 is made of the left and right braces that are transversely connected, with the top rod 40 available with guides 41 that limits the hose. Beneath the rod 40 there is a parallel strip 42 that has a plurality of holes 421 allowing a retaining rod 43 to pass through the strips 42 on the left and the right (FIG. 2). Support 27 of the gearing kit 2 comes secured on the transverse rod 44 between the two foot rests of the structural rack 4 by means of braces 271, of which the tops are threaded to attach a cap 272. The axle center 26 of the gearing kit 2 sits on the cap 28 as it passes through first gear 20 and one end of axle center 25 passes through the second gear 21 and sits onto brace cap 28, while the other ends of the axle centers 25, 26 pass through support 27 and then the third and fourth gears 22, 23 respectively, axle center 24 is mounted between the front and the rear plate of support 27, having one end secured to winch 1 and the axle center 5, while the other end of the axle center 24 engages the fourth gear 23 before being mounted on support 27. Axle center 6 passes through the center of axle hole 10 of winch 1 and it passes through axle center 24, the fourth and the first gear 23, 20 and the axle hole of brace cap 28, allowing the end to be fixed on long arm 30 of handle 3.

Figure 4:
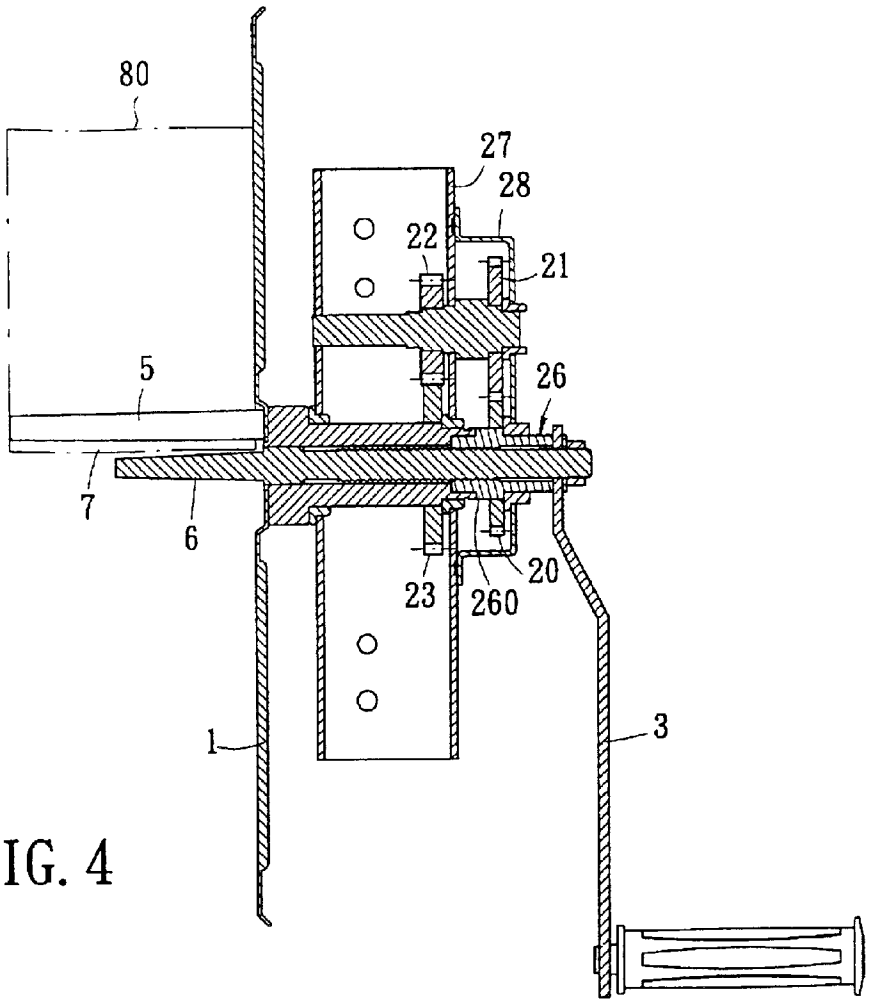
FIGS. 4, 5 Section views of the reeling structure of this invention.
Figure 5:
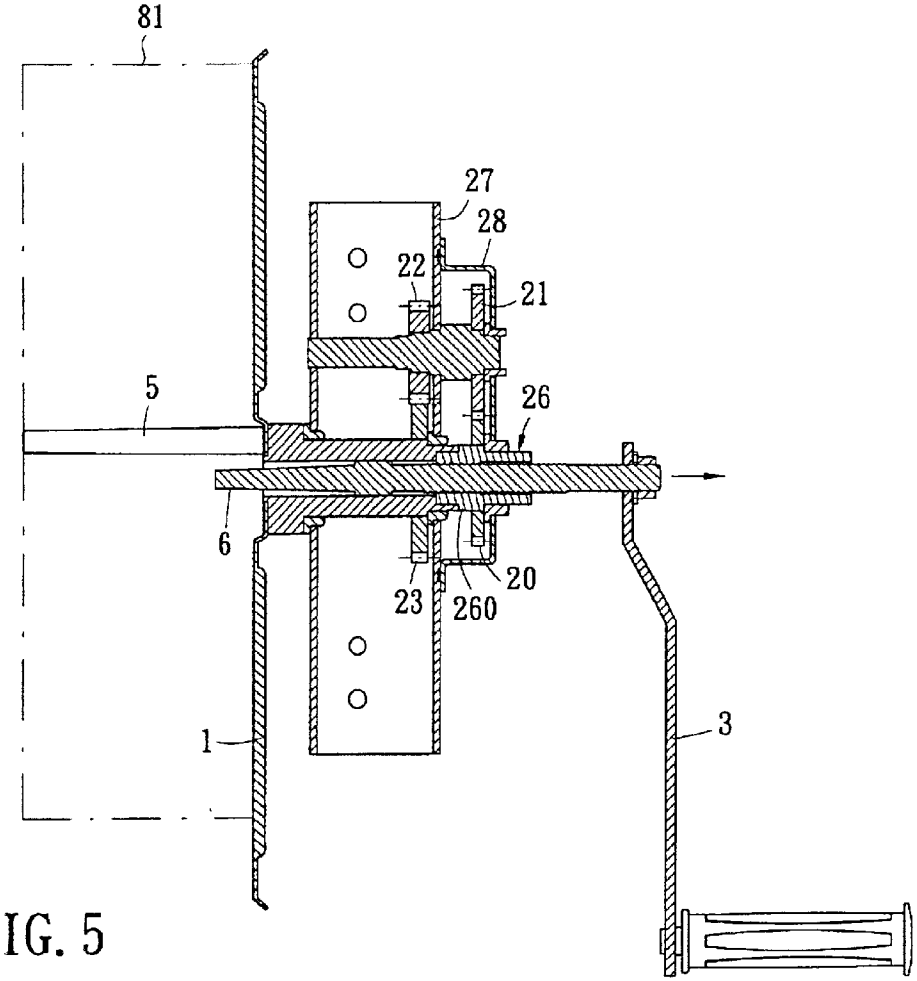

Referring to FIG. 4, 5, where the principle of action of the transmission of this invention is shown, with the first gear 20 in direct engagement with the second gear 21, the third gear 22 in coaxial movement with axle center 25 and the second gear 21 before transmitting the movement to the fourth gear 23 with which it is engaged, where the first and the second gear 20, 21 have identical teeth diameter in constant speed drive and with the gear diameter of the third gear 22 less than that of the fourth gear 23, constructing a reducing movement the transmission from the first gear 20 to the fourth gear 23. The axle centers 24, 25 and 26 of this invention are on either support 27 or brace cap 28 and rotate along with the gears, where axle center 24 is engaged with one end of axle center 26, but the two are not coupled or attached and thus can rotate relative to one another. A section of the inner diameter of axle center 26 forms thread 260 and is threaded with thread 60 of the moving axle center 6. Thus, when turning the handle 3 clockwise, the axle center 6 moves toward the winch 1 and the axle center 26 drives the first gear 20 when the side of the long arm 30 of the handle 3 comes against the side of axle center 26. Then movement is transmitted to the second gear 21, third gear 22 to the fourth gear 23, and movement is transmitted from the axle center 24 coupled with the fourth gear 23 to the secured winch 1. Again, between the protruding axle center 5 on the winch 1 and the moving axle center 6, a clearance 7 is formed that allows the fire hose 80 be housed in said clearance 7, being thus reeled in a roll with the winch 1. After reeling the fire hose 80, the handle 3 is turned counterclockwise and the moving axle center 6 turns and retreats from the winch 1 (FIG. 5) while the gears remain still. After the moving axle center 6 retreats from the winch 1, the center hole of the fire hose roll 81 further loosens to reduce the friction created by the removal of the fire hose roll 81, allowing easy removal of the fire hose roll 81.

Figure 6:
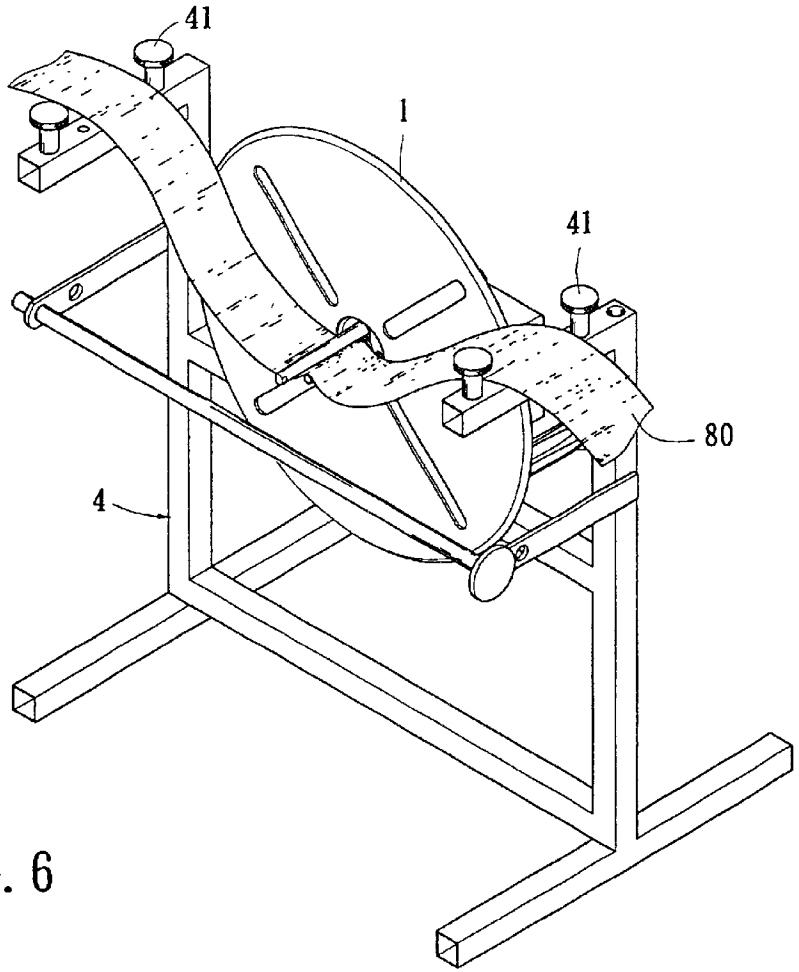
FIGS. 6, 7 Vertical assembly layouts of the reeling operation of this invention.
Figure 7:
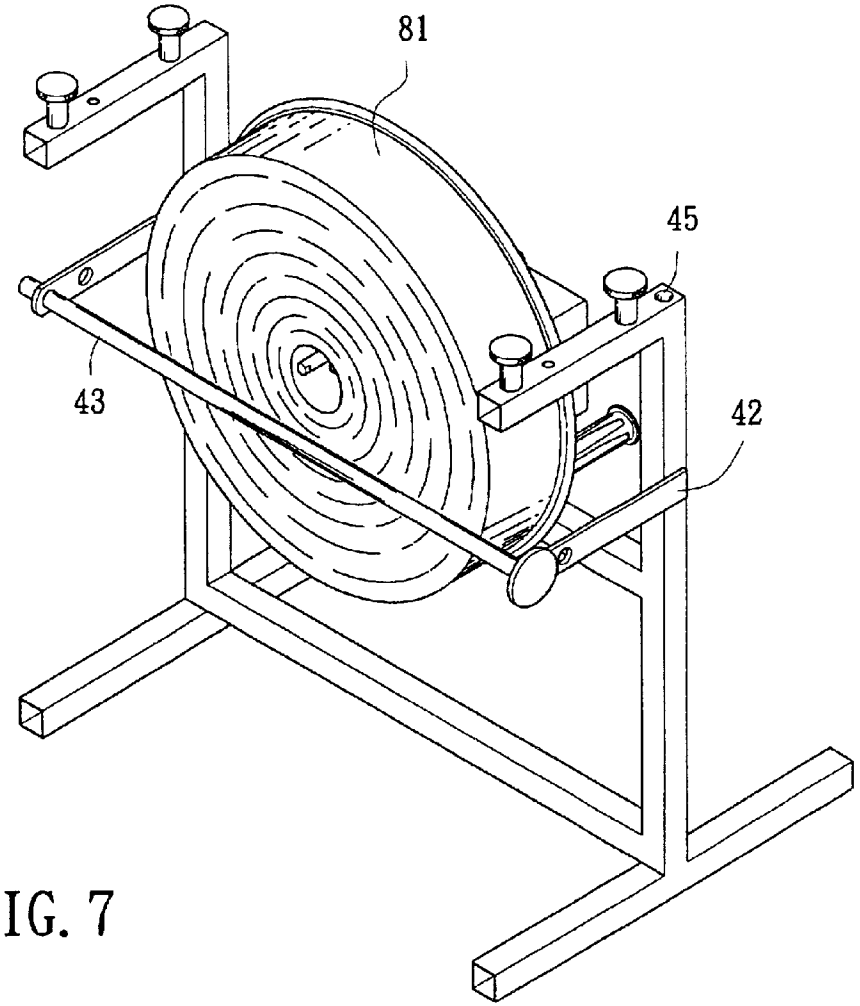

When reeling the fire hose 80 as suggested in this invention, the fire hose 80 ready to be reeled may be spread on top of the top rod 40 of the structural rack and be restrained within the guides 41, preventing the fire hose 80 from moving in a zigzag manner during the reeling. The reason why the limit is formed between the left and right side of the structural rack 4 is that when reeling the fire hose 80, the mid section extends toward both sides (FIG. 6). Again, to form the reeled fire hose roll 81 with even edges, in particular on the other side of the winch 1, the retaining rod 43 of this invention is mounted in the front of the winch 1 at an adjustable distance by the holes on the strip 42, making it roughly equal to the width of a flattened fire hose 80, constructing a limiting effect formed by the retaining rod 43, restraining the fire hose 80 when overlapping the same when reeling, reaching a full roll 81 with flattened edges. The retaining rod 43 is freely inserted in the long strip 42 for easy removal after reeling. When removing said retaining rod 43, it can be inserted into opening 45 of the structural rack 4 for storage.

What is claimed is:

1. A reeling device for a fire hose, comprising:

a winch having at a center thereof an axle hole for passage of two axle centers;

a gearing kit, including first, second, third and fourth gears and a plurality of axle centers for positioning said gears, and a support supporting the axle centers and a brace cap;

a handle having a grip and a long arm of which one end is perpendicular to the grip;

a structural rack, a frame that houses said winch, the gearing kit and the handle for the reeling of the hose;

a fixed axle center, located at an eccentric position of the axle hole of said winch, having one end secured to the axle center end of the fourth gear; and a moving axle, passing through the center of the axle hole of the winch and the axle centers of the fourth and the first gears, allowing one end thereof to join the long arm of the handle, for telescopic movement to and from the winch through its rotation.

2. The reeling device as claimed in claim 1, wherein said gearing kit forms a reducing transmission with the first gear engaged with the second gear of identical diameter before transmitting the reeling force from the third gear in coaxial engagement with the second gear to the fourth gear in coaxial engagement with the first gear, where the diameter of the third gear is less than that of the fourth gear.

3. The reeling device as claimed in claim 1, wherein one end of the fixed axle center is connected onto the end of the axle center of the fourth gear.

4. The reeling device as claimed in claim 1, wherein the moving axle center includes an outer thread, and the axle center of the first gear includes an inner hole having a threaded section that permits engagement by threading with the thread of the moving axle center and when the handle is rotated the moving axle center is axially moved to engage the handle against one end of the axle center of the first gear, thereby driving the first gear.

5. The reeling device as claimed in claim 1, wherein a top of said structural rack includes two parallel protruding rods having two spaced guides.

6. The reeling device as claimed in claim 5, wherein the fire hose, is housed between the two guides when reeled.

7. The reeling device as claimed in claim 1, wherein said structural rack includes a retaining rod.

8. The reeling device as claimed in claim 7, wherein said retaining rod is located in front of the winch.

9. The device as claimed in claim 7, wherein said retaining rod is positioned in the hollowed structure of the structural rack.

10. The reeling device as claimed in claim 1, wherein of said gearing kit, the winch and the handle are located on a transverse rod of the rack between left and right foot rests.

11. The reeling device as claimed in claim 1, wherein a clearance is formed between the fixed and the moving axle centers on the winch.

12. The reeling device as claimed in claim 11, wherein the fire hose is reeled through the clearance formed between the fixed and the moving axle centers.

* * * * *